United States Patent [19]

Slamecka

[11] Patent Number: 4,524,257

[45] Date of Patent: Jun. 18, 1985

[54] HIGH-VOLTAGE GAS-BLAST PUFFER TYPE CIRCUIT-BREAKER

[76] Inventor: Ernst Slamecka, Alt-Pichelsdorf 13, D-1000 Berlin 20, Fed. Rep. of Germany

[21] Appl. No.: 355,517

[22] Filed: Mar. 8, 1982

[30] Foreign Application Priority Data

Mar. 30, 1981 [DE] Fed. Rep. of Germany ..... 3113325
Jun. 16, 1981 [DE] Fed. Rep. of Germany ..... 3124075

[51] Int. Cl.[3] ..... H01H 33/88
[52] U.S. Cl. ..... 200/148 A; 200/148 R
[58] Field of Search ..... 200/148 A, 150 B, 148 R

[56] References Cited

U.S. PATENT DOCUMENTS

| | | | |
|---|---|---|---|
| 3,881,079 | 4/1975 | Zuckler | 200/148 A |
| 3,991,292 | 11/1976 | Perkins | 200/148 A |
| 4,015,095 | 3/1977 | Bitsch et al. | 200/148 A |
| 4,321,439 | 3/1982 | Hess et al. | 200/148 A |

FOREIGN PATENT DOCUMENTS

| | | | |
|---|---|---|---|
| 2759264 | 5/1979 | Fed. Rep. of Germany | 200/148 A |
| 1549863 | 8/1979 | United Kingdom | 200/148 A |

*Primary Examiner*—Robert S. Macon

[57] ABSTRACT

A gas-blast puffer type $SF_6$ circuit-breaker exhibiting essentially features as follows:

Dual-blast nozzle arrangement wherein a first nozzle being made of electrically conductive material, and a second nozzle being made of electrically insulating material;

a movable compression cylinder of electrically insulating material bearing a tube-shaped contact piece intended for carrying mainly continuous current;

a nozzle-shaped arcing contact piece connected mechanically rigid and electrically suitable for carrying current with said movable contact piece.

The further improvement to said inventive concept characterize:

A first compression cylinder of electrically insulating material surrounding temporarilly the nozzle arrangement and being engaged with a first fixed piston;

a second compression cylinder of metal being engaged with a temporarilly catchable compression piston, both cylinders and pistons establishing a first and a second volume, said volumes communicating pneumatically with each other in a controllable manner, representing during an opening operation a high-performance gas compression system.

6 Claims, 3 Drawing Figures

HIGH-VOLTAGE GAS-BLAST PUFFER TYPE CIRCUIT-BREAKER

SUBJECT OF THE INVENTION

This invention relates in particular to a $SF_6$ circuit-breaker which relies on a pump or puffer for forcing a blast of relatively cool gas into the arcing region of the breaker to promote arc extinction.

BACKGROUND OF THE INVENTION

U.S. Pat. No. 3,551,626 discloses a puffer type circuit-breaker comprising a tube shaped fixed contact piece and a rod shaped movable contact piece representing at the same time a single nozzle configuration. During an opening operation an arc is established in the appearing gap, and means for forcing a blast of arc extinguishing gas into the arc region are provided for. Said means consist mainly of an arrangement of a fixed cylinder and a movable piston having a cylindrical extension of insulating material.

Said extension surrounds the contact pieces during their closed position. During a current interruption the extension surrounds the arc further condensing the gas and directing a blast of it towards the arc. Additionally the cylinder of insulating material prevents the arc from eroding the wall of the housing made of insulating material. In the open position of the contact pieces the extension is removed from the gap zone being thus established in a free gas atmosphere. Disadvantage with the heretofore known circuit-breaker: reduced interrupting capacity due to the application of a single-blast nozzle arrangement.

From the Federal-Republic-of-Germany Pat. No. 19 66 972 has become known to combine a dual-blast nozzle arrangement with a compression cylinder in principle functioning similarly to the cylindrical extension as described in the U.S. Pat. No. 3,551,626.

Whereas the compression cylinder of said German patent is made of insulating material, too, in a variant to this construction, according to the Federal-Republic-of-Germany Pat. No. 22 11 617 the compression cylinder is made of electrically conductive material working also as movable contact piece carrying mainly the continuous current. In both cases the stationary nozzles consist of electrically conducting material. Disadvantage with the heretofore known circuit-breaker: nozzles made of electrically conductive material bring about basically at higher rated voltages an unfavorable influence of their dielectric dimensioning on their gas flow behaviour and vice versa.

In contrary to the foregoing German patents the U.S. Pat. No. 4,086,461 describes a stationary dual-blast nozzle arrangement employing for the nozzles electrically insulating material. Disadvantage with the heretofore known circuit-breaker: due to the nozzles made of electrically insulating material arcing contacts are necessary inside of both nozzles. This complicates the construction considerably.

A movable dual-blast nozzle system whereat both nozzles are made of insulating material discloses U.S. Pat. No. 4,048,456.

A movable dual-blast nozzle arrangement with one nozzle being electrically insulating whereas the other nozzle being electrically conductive became known from the Federal-Republic-of-Germany-Non-Prosecution-Application No. 28 28 773.

Common disadvantage with the heretofore known circuit-breakers:

Problem of optimizing a dual-blast nozzle arrangement due to limited space; hazard of hot gases escaping from the nozzle and penetrating into the surrounding space reducing there the dielectric strength.

The proposals, so far known, dealing with the problem of increasing the pressure of the quenching gas at a given time for compression or reversely to reduce the compression time at a given gas pressure may be attributed to three different systems:

Systems with a single compression cylinder being engaged with a single movable compression piston.

Such systems are described e.g. in the Federal-Republic-of-Germany Pat. No. 19 66 973 and Federal-Republic-of-Germany-Non-Prosecution-Application No. 22 45 423.

Disadvantage with the heretofore known circuit-breakers: additional gear members being partially spring driven involve increased operating energy due to friction losses and additional failure hazard.

Systems with a graduated single compression cylinder being engaged with an appropriate compression piston consisting of a fixed and a movable component piston being arranged in parallel.

An example referring to this is given in the Federal-Republic-of-Germany-Non-Prosecution-Application No. 23 61 687.

Disadvantage with the heretofore known circuit-breakers: low utilization of the space being at disposal necessitates large dimensions; employment of a spring for support of the movable piston component.

Systems employing a single compression cylinder being engaged with a fixed and a movable compression piston arranged in series.

An appropriate example is disclosed in the Federal-Republ.-of-Germany Pat. No. 27 347.

Disadvantage with the heretofore known circuit-breakers: appreciable constructional expenditure and limited compression rate.

For a reduction of the energy necessary for the actuation of the contact pieces and compression of the quenching gas it turned out to be better to perform these two operations not simultaneously but one after the other. This offers the further advantage of saving operational energy by transformation of mechanical energy into pneumatical energy. One possibility of realization offers the employment of a special gear to actuate the compression cylinder and compression piston according to the Federal-Republic-of-Germany-Non-Prosecution-Application No. 29 14 033. Disadvantage with the heretofore known circuit-breaker: a multitude of gear members complicates the construction; need for additional operational energy due to friction losses and acceleration of gear members; problems to controll precisely the set in of gas compression.

AIM OF THE INVENTION

The invention is aiming at a general technical improvement of the existing high-voltage puffer type $SF_6$ circuit-breakers.

In a first step this will result in a higher rated voltage per single interrupting unit at a given or even increased rated short-circuit interrupting current. Thus the number of interrupting units per circuit-breaker pole may be appreciably reduced—e.g. only two breaking units per 550 kV circuit-breaker pole or one unit per 300 kV pole—rendering the circuit-breakers more reliable due to the reduced number of components.

In a second step the gas puffer system will be made more effective avoiding at the same time a complicated and costly gear system for the actuation of the pump. Furthermore the breaking time will be reduced up to two cycles at 60 Hz.

High-voltage puffer type circuit-breakers of conventional design for high short-circuit interrupting currents need still a powerful and consequently costly operating mechanism as a result of the coincidence of the acceleration of the movable components with the gas compression. Owing to this situation it is a third aim of the invention to reduce appreciably the energy being necessary for the actuation of the circuit-breaker, or reversely, to increase the short-circuit interrupting current at a given operating energy. This will be done without complicating the operating mechanism.

REALIZATION OF THE INVENTION

The aim of this invention as indicated in the foregoing section is realized as hereafter summerized, elucidated by figures and defined by claims.

SUMMARY

The major problems being still imposed on $SF_6$ puffer type circuit-breakers as laid down under the title "Background of the invention" are solved as follows:

In a stationary dual-blast nozzle arrangement a first nozzle is made of electrically conductive material whereas a second nozzle is made of electrically insulating material. In doing so the advantages of high thermodynamic efficiency and high dielectric strength are integrated into a pressurized arcing chamber.

The contact system is splitted into two components: The system for carrying the continuous current is arranged outside of the compression cylinder. To make this feasible said compression cylinder of insulating material carries a comparatively thin tube of copper. The movable arcing contact piece is arranged inside of the dual-blast nozzle arrangement drawing thus the arc right away at the proper spot.

All movable parts of the contact system are connected with each other mechanically rigid and suitable for carrying electrical currents. They are jointly operated together with the compression cylinder whereat the actuating rods are arranged in such a way as not to impede the downstream gas flow.

To reduce the electrical field strength in the interrupting zone the front sides of the movable contact pieces for the continuous current and arc current complement one another to a large electrode.

For $SF_6$ puffer type circuit-breakers the time needed for the compression of the gas is decisive on the total duration of the interrupting process.

Consequently emphasis has to be put on to shorten the compression time as far as possible introducing simultaneously straightforwardness and reliability into the new design.

This problem is solved by substituting a conventional single acting compression arrangement in favour of a dual acting one. Said new compression arrangement is characterized by two compression cylinders of different diameter and material both being engaged with two appropriate piston. The first piston is fixed whereas the second piston is resting during the initial time interval of the interrupting process in a locked position, said locking means being set off in the course of the travel of the second cylinder.

The first cylinder-piston arrangement which is made mainly of insulating material represents a pressurized chamber surrounding the arc interruption zone. The second cylinder-piston arrangement which is made of metal acts as an adjustable gas compressor boosting additionally $SF_6$ gas into the arcing chamber.

A further main feature represents the pneumatical communication between the two cylinder-piston arrangement being located outside of the permanently fixed piston, and comprising a check valve.

The dual-acting compression system offers also the advantage that even after the release of the gas flow through the nozzles the second cylinder piston arrangement is still in a position to boost gas into the arcing zone increasing thus the interrupting capacity.

A third feature of the invention represents the reduction of the energy being necessary for the operation of high-voltage puffer type circuit-breakers. The procedure is as follows:

In the course of a current interruption in a single gas volume or in a first gas volume, provided the compression system consists of two separate gas volumes, the quenching gas is compressed simultaneously with the opening stroke. However, the extent of that first gas compression is yet small.

Not until shortly before a minimum arc length, being the precondition of a successful current interruption, the first compression rate is increased appreciably, e.g. by action of a second gas compression arrangement contributing to the compression of the first gas volume.

This is achieved e.g. by longitudinal slots in the wall of the puffer cylinder. By variation of the length of those slots the initiation of the additional gas compression can be controlled.

During this second stage of gas compression kinetic energy of the moving components is transformed into potential energy of the gas.

Around the end of the compression stroke the second compression piston clicks into the wall of the appropriate compression cylinder. By means of this transient connection of the piston with the cylinder the operating mechanism of the circuit-breaker is relieved from the gas pressure.

Further objects and advantages will readily become apparent upon reading the following description, given in conjunction with the drawings of embodiments.

BRIEF DESCRIPTION OF THE SEVERAL VIEWS OF THE DRAWINGS

FIG. 4 is a view similar to that of FIG. 2, showing the embodiment of the circuit-breaker improved by an impuls gas compression system.

DETAILED DESCRIPTION OF THE PREFERRED EMBODIMENTS

Figure 1:
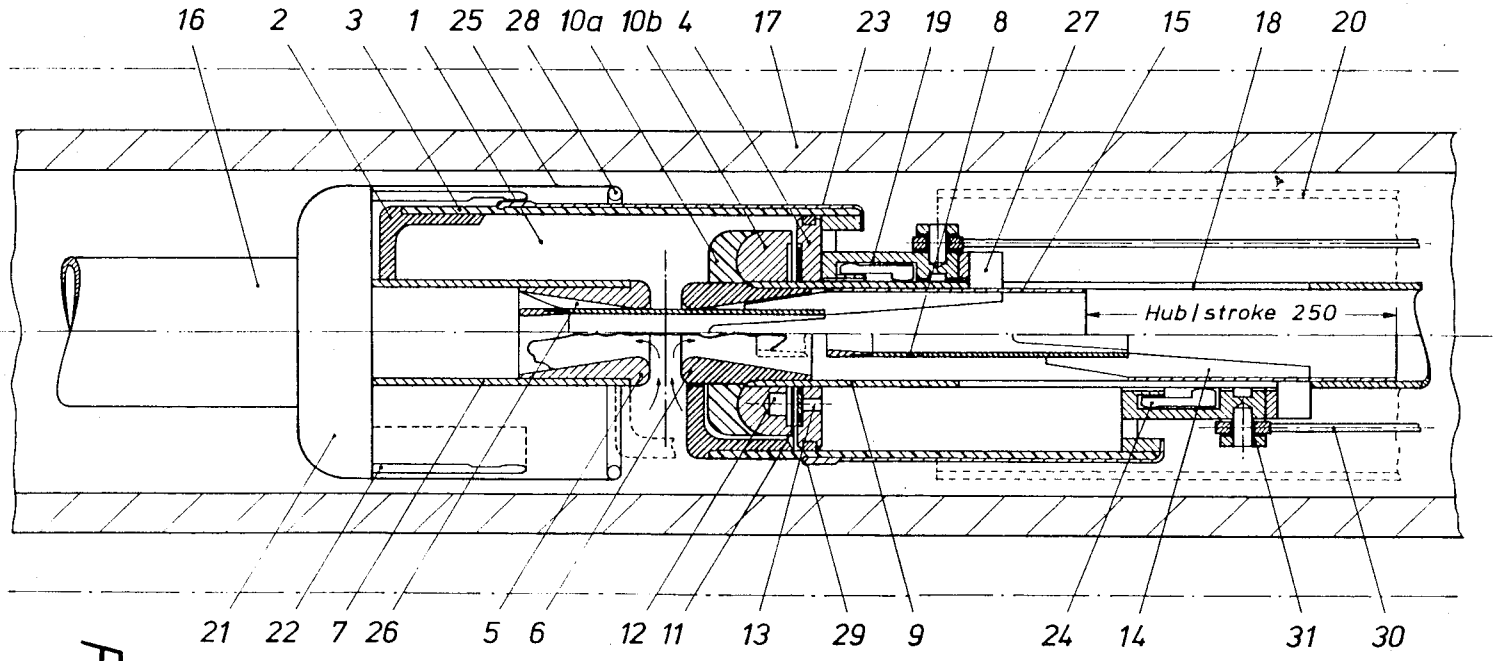
FIG. 1 shows a longitudinal sectional view of a first embodiment of a circuit-breaker constructed in accordance with the invention. The specific feature represents the stationary dual-blast nozzle arrangement with one nozzle made of electrically conductive material whereas the opposite nozzle consists of electrically insulating material. The circuit-breaker is demonstrated in three switching positions: closed, arc quenching, open.

Referring to FIG. 1 the description will follow the substantial functional groups as there are: gas compression system, gas flow system, system for carrying the continuous and short time current, system for carrying the arc current, dielectric system and actuating system.

GAS COMPRESSION SYSTEM

The gas compression employed here is of single-acting type. It is realized in the volume (1) made up by the compression cylinder (3), carrying at the frontside a cap (2), and the fixed compression piston (4). Further there have a share on the walls of the volume (1) the external surfaces of the nozzles (5,6), the pipe (7) for one part of the down stream gas flow, the arcing contact tube (8) and the filling component consisting of the electrically conductive member (10*a*) and, at the front side, of the electrically insulating member (10*b*).

In an advantageous manner the compression piston (4) as well as the filler and the insulating nozzle (6) are mounted on the pipe (9) provided for carrying the other part of the down stream gas flow.

Between the metallic part of the filler and the compression piston a movable flat ring (11) is serving as a valve, in connection with a spring, however, being not shown there. Said valve closes the compression volume (1) when during an opening operation the inside pressure exceeds the outside pressure.

During a closing operation the valve opens making thus possible a refilling of the volume (1).

The pressure of the arc quenching gas may be controlled by the overlapping length between the arcing contact tube (8) and the electrically conductive nozzle (5).

GAS FLOW SYSTEM

The gas flow sets in as soon as during an opening operation the arcing contact tube (8) separates from the inside surface of the electrically conductive nozzle (5). Provided a voltage is applied to the terminals of the circuit-breaker an electric arc is initiated between the two electrodes, right away inside of the nozzle space. This represents a basical progress compared with other existing solutions mentioned previously.

During a first time intervall after the arcing contact separation the gas flow can make use only of the full cross-section of the electrically conductive nozzle. At the other side the gas flow is controlled by the smaller cross-section of the arcing contact tube being shaped like a nozzle, too.

As a result of the reduced gas flow in the case of switching small inductive currents the arc current remains stable until shortly before its natural zero. Switching overvoltages being proportional to the value of the instable (chopped) current are thus limited quite naturally.

The interruption of short-circuit currents needs a longer arc length due to the increased imput of thermal energy into the gap. In this case the reduced gas flow offers the advantage of a reduced arc power, too, due the reduced arc cooling until to the minimum arc length. Beyond this arc length the throat of the insulating nozzle is cleared by the retracting arcing contact enabling its full participation in the arc quenching process. Such an arc quenching position is illustrated in the figure.

It should be emphasized here that due to the combination of an electrically conductive nozzle with a nozzle being electrically insulating the gap length between the nozzles and the diameter of them can be dimensioned taking into account only the gas flow conditions being not influenced by the dielectric conditions and vice versa. Furthermore it is well known that a stationary symmetrical dual-blast nozzle arrangement represents the most effective means for the de-ionization of the arc plasma.

The tube (8) of the movable arcing contact is connected by means of the ribs (14) with the sliding and guiding cylinder (15) transmitting at the same time the current to the contact fingers (24).

From the electrically conductive nozzle (5) the gas flows through the pipe (7) into the adjacent support pipe (16). This pipe is connected with the end flange of the porcelain housing, however, no more visible in the drawing. The quenching gas escaping the electrically insulating nozzle (6) is getting first into the pipe (9), and further, no more visible in the drawing, into the gear box. Additionally the quenching gas can escape through longitudinal slots (18) in the pipe (9). If necessary a screening cylinder (20) can be provided for, protecting the surface of the porcelain housing (17) from hot gases.

CONTACT SYSTEM FOR CARRYING THE CONTINUOUS CURRENT AND THE SHORT TIME CURRENT

This contact system consists of two fixed contact pieces and a contact bridge. One of the fixed contacts is realized by elastic contact fingers on the support (21). The other fixed contact piece represents coincidently the down stream gas pipe (9).

The movable contact piece between the two fixed contacts pieces is made up as follows: On the outer surface of the compression cylinder (3) of insulating material a copper tube (23) is shrink fitted. At the one end of the contact tube the contact fingers are resting.

At the other end the contact tube is connected electrically with the movable contact fingers (24) by intermediate of the structural component (19). Due to this arrangement of the contact system outside of the compression cylinder (3) it is protected against all sorts of influences of the arc and hot gases.

CONTACT SYSTEM FOR CARRYING THE ARC CURRENT

During the separation of the contact pieces for carrying the continuous and short time current in the course of a current interruption they are paralleled by the arc contact system. This contact system consists of the surface of the throat of the electrically conductive nozzle (5) and the outer surface of the movable contact tube (8). Where necessary the transition of the current between the arc contacts can easily be still improved by application of contact ribs (26) inside of the nozzle. The influence of such ribs on the gas flow is small.

After building up an appropriate gas pressure in the volume (1) and commutation of the current the arcing contacts separate. Here again the arcing contact system exhibits the advantage that the arc drawn is immediately exposed to the gas flow preparing its interruption. Thus any time delay needed elsewhere for moving the arc from the outer surface of the nozzle (5) into its throat is avoided.

From the arching contact tube (8) the current flows through the ribs (14) to the sliding cylinder (15). This cylinder is connected by means of other ribs fixed on its surface with the structural component (19) providing a further current path to the contact fingers (24) and gas pipe (9).

DYNAMIC ELECTRIC SYSTEM

Immediately after the separation of the arcing contacts the dynamic dielectric system consists of the stationary electrically conductive nozzle (5) and the arcing contact tube (8).

With increasing contact distance the influence of the field grading electrodes is becoming more and more relevant. At the side of the fixed contact pieces this is the ring electrode (28) attached to the rim of the cylinder (25). At the side of the movable contact pieces the arcing contact (8) is electrically screened by the ring electrode (29) being attached to one end of the contact tube (23) on the compression cylinder (3). With further increasing contact distance the influence of the ring electrode (29) on the electric field is disappearing. Now the influence of the large sized electrode represented by the metalic filler (10*b*) emerges up to domination.

STATIC DIELECTRIC SYSTEM

Belonging to the open position of the circuit-breaker this system is characterized by the electrically conductive nozzle (5) with the appropriate field grading electrode (28) at one side of the open gap and the metallic filler (10*b*) at the other side.

The optimization in particular of the static dielectric system can be implemented independently of the optimization of the gas flow system. This feature in combination with electrodes of large surface at both sides of the gap may be deemed as a considerable progress in the technique of stationary dual-blast nozzle arrangements.

ACTUATING SYSTEM

The actuating energy for the movable contact pieces and compression cylinder is transmitted from the operating mechanism through a gearing—both, however, not shown in the figure—by means of two rods (30) being pivotally fixed in (31).

HOUSING OF THE ACTIVE PARTS FOR CURRENT INTERRUPTION

The example given describes the interrupting chamber of an outdoor life-tank type circuit-breaker. Accordingly the housing (17) is realized by a porcelain vessel having at both ends connecting flanges, however, not shown here. At the side of the fixed contact pieces on the flange is mounted a cap providing an expansion volume for the hot gas and carrying outside the terminals for connecting the circuit-breaker to the bus conductor. At the side of the movable contact pieces the porcelain cylinder is connected by its flange to the gear box of the circuit-breaker in the case of a two- or three-unit per pole type.

Figure 2:
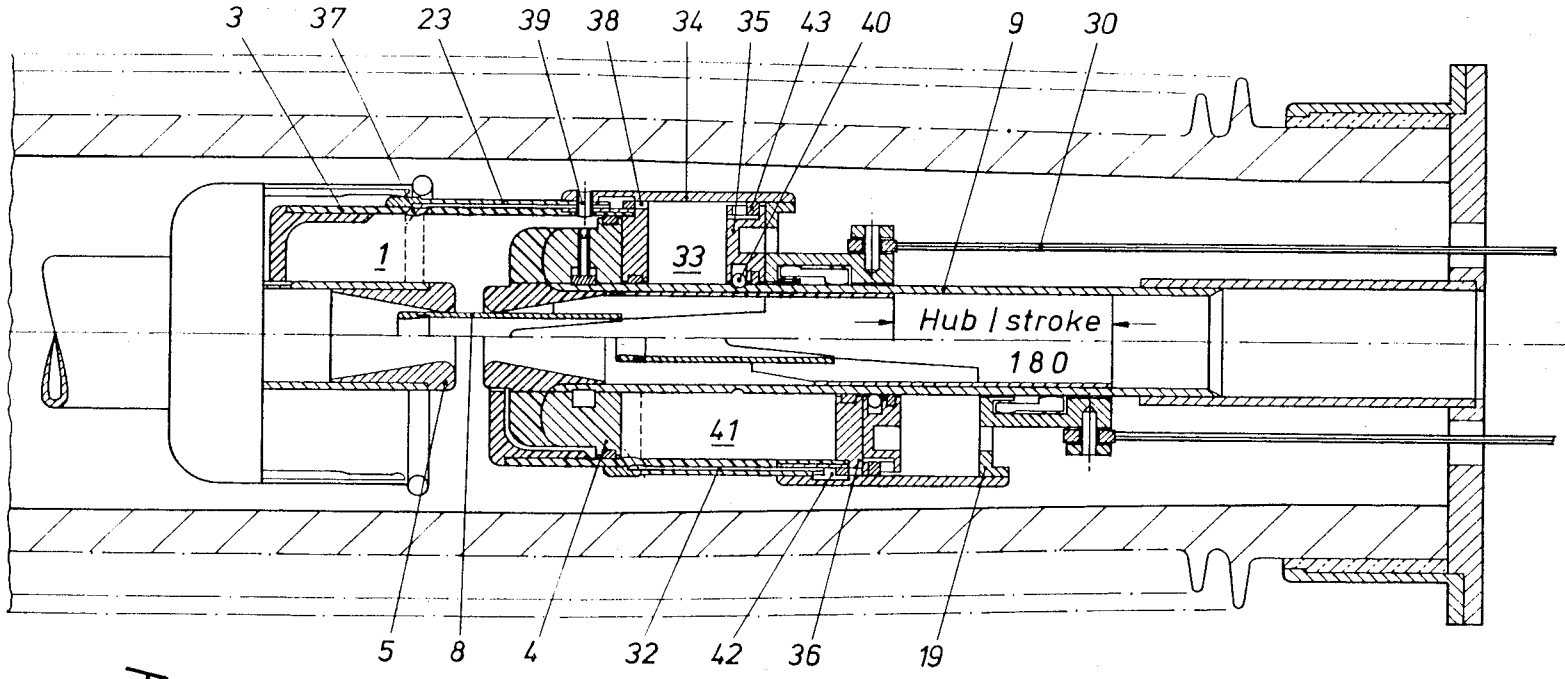
FIG. 2 is a view similar to that of FIG. 1 but showing the first embodiment improved by a dual-cylinder high-performance compression system characterized by a fixed and a movable piston. The circuit-breaker is demonstrated in the closed and open position.

Referring to FIG. 2 the single-acting gas compression system according to the FIG. 1 has now been improved by the introduction of a dual-acting gas compression system of high performance. As before the gas compression being decisive for the current interruption is done in the first compression volume (1). It surrounds the dual-nozzle arrangement during the precompression and arcing period.

In the same manner as with the embodiment according to the FIG. 1 to the compression cylinder (3), being called here the first one, is attached a contact tube (23). However, this contact tube now makes up additionally together with the compression cylinder (3) a channel (32) for the gas communication between the first (1) and the second (33) gas volume. A check valve (42) controls the gas flow through the openings (38) being possible only in the direction from the volume (33) to the volume (1).

In the first time interval of an opening operation the movable compression piston (35) remains catched by means of spring loaded balls and a notch round the surface of the gas-pipe (9). An other check valve (43) prevents the gas from escaping during an opening operation and enables the refilling of the volume (33) to be done during a closing operation.

RUN OF A GAS COMPRESSION

The actuating rods (30) are moving the contact pieces (23) and (8) in connection with the compression cylinders (3,34) into the opening direction. Therefrom the gas pressure is rising in both volumes (1,33), however, with different rates of rise. Due to its comparatively smaller height the rate of rise of the gas pressure in the volume (33) is superior to that in the volume (1). Hence a flow of gas is forced from volume (33) into the volume (1).

In the example as just being described the rate of precompression is about 1.7. Inspite of this comparatively high compression rate the total stroke of the compression and contact system is only 180 mm. If necessary a further increase of the compression rate would be easily feasible by increasing only slightly the outside diameter of the second compression cylinder (34). At the other hand in this way at an unchanged compression rate the time needed for it can be reduced appreciably. This again results in a very small breaking time unsurpassed by the conventional $SF_6$ puffer type circuit-breakers.

Furthermore the compression system according to the invention can be easily designed as to provide quenching gas even after the release of the gas flow into the nozzles compensating thus the pressure drop. This feature is of high importance for restrike free switching of capacitive currents at very high voltages.

In the course of the opening operation a volume is appearing between the fixed piston (4) and the cap (36) on the cylinder (34). For the ventilation of this volume holes (39) are provided for at the end of the wall of the compression cylinder (3).

Figure 3:
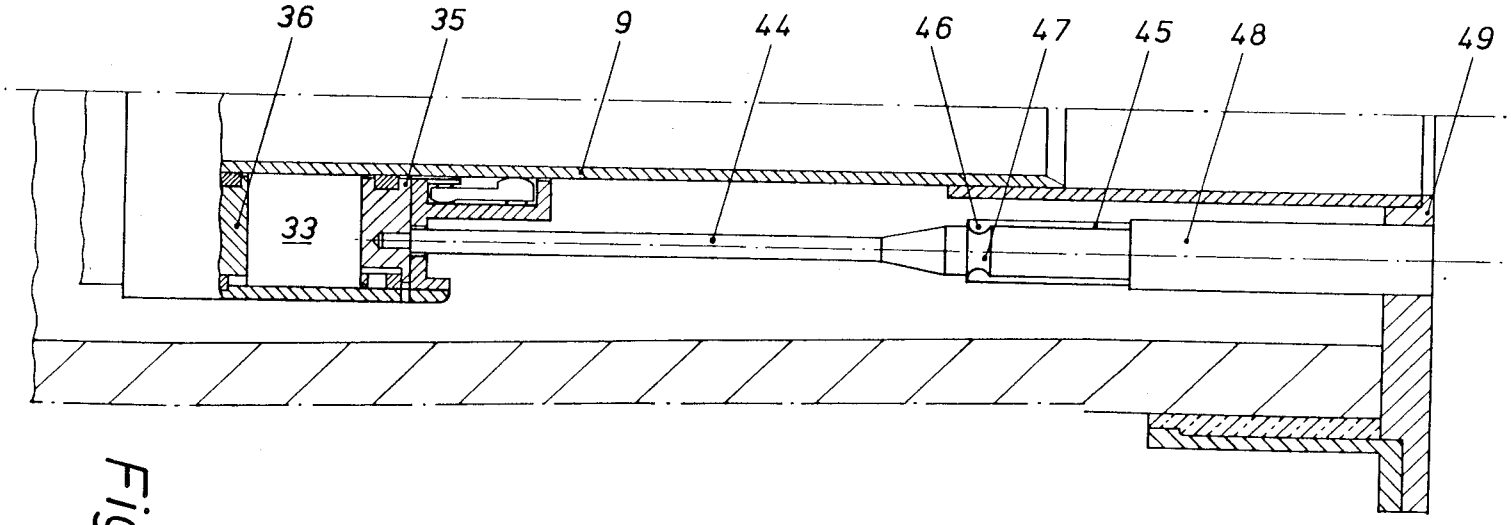
FIG. 3 shows a preferred clicking system for the movable compression piston according to FIG. 2.

Referring now to FIG. 3, there is illustrated a favourable variant of the notching system for the compression piston (35). Following this design the movable compression piston is mounted on the tips of three rods (44) being distributed along the circumference of a circle. At the other end each rod dips into a ring of elastic fingers (46) catching a notch (47) round the rod surface. By means of a tube (48) surrounding those fingers their elasticity can be easily adjusted. Thus the piston (35) remains fixed until the maximum gas pressure is reached. Then the cap (36) takes along the piston (35) into the open position.

What I claim as my invention and desire to secure by Letters Patent is:

1. A gas-blast puffer-type circuit-breaker comprising:

dual-blast nozzle arrangement, wherein two nozzles facing each other in a fixed axial distance;

said dual-blast nozzles, each of them ending in a gas flow absorbing volume, being temporarilly surrounded by a movable single compression cylinder;

separated contact pieces for carrying continuous and arc current respectively;

the improvement of said circuit-breaker characterizing:

dual-blast nozzle arrangement, wherein a first nozzle (5) being made of electrically conducting material whereas a second nozzle (6) being made of electrically insulating material;

a movable compression cylinder (3) of electrically insulating material bearing a contact piece (23) being intended for carrying continuous current;

an arcing contact piece (8) being connected mechanically rigid and suitable for carrying electrical currents with said movable contact piece (23).

2. The invention according to claim 1, wherein a piston (4) being fixed on a gas pipe (9) next to the second nozzle (6) made of electrically insulating material.

3. The invention according to claim 1, wherein a variable first spacial unit (1) and a variable second spatial unit (33) being mechanically connected, said spatial units having the same inner diameter and different outer diameters;

said variable spatial units communicating pneumatically with each other in a controllable manner, said pneumatical communication (32) being arranged outside of a fixed partition (4) separating said spatial units.

4. The invention according to claim 3, wherein said variable first spatial unit (1) being established by a first compression cylinder (3) being made of electrically insulating material, being engaged with a first piston (4) being made partially of insulating material;

said variable second spatial unit (33) being established by a second compression cylinder (34) being made of metal, being engaged with a second movable piston (35) of metal, being arranged temporarilly catchable.

5. The invention according to claim 3, wherein on said first compression cylinder (3) being attached a tube shaped electrically conducting member (23), between said member and the outer surface of said compression cylinder being arranged a channel like hollow space (32), connecting the spatial units (1,33) pneumatically, in said hollow space being positioned a check valve.

6. The invention according to claim 4, wherein the clear distance between a cap (36) of the second compression cylinder (34) and the second catchable piston (35) being larger compared with the overlapping length between the movable arcing contact piece (8) and the first nozzle (5) made of electrically conducting material.

* * * * *